US006021572A

United States Patent [19]

Smith

[11] Patent Number: 6,021,572

[45] Date of Patent: Feb. 8, 2000

[54] HAND-HELD SELF DEFENSE WEAPON WITH PROTECTIVE COVER

[76] Inventor: Robert L. Smith, 523 N. SR 21, Hawthorne, Fla. 32640

[21] Appl. No.: 09/020,442

[22] Filed: Feb. 9, 1998

Related U.S. Application Data

[60] Provisional application No. 60/066,606, Nov. 26, 1997.

[51] Int. Cl.[7] ..... B26F 1/00

[52] U.S. Cl. ..... 30/368; 30/123; 30/164

[58] Field of Search ..... 30/366, 368, 123, 30/151, 162, 286, 164; 7/158, 170; 116/DIG. 44

[56] References Cited

U.S. PATENT DOCUMENTS

| | | | |
|---|---|---|---|
| 75,382 | 3/1868 | Davis et al. . | |
| 723,260 | 3/1903 | Freh | 30/123 X |
| 1,424,221 | 8/1922 | Trumpeter | 30/162 |
| 1,679,666 | 8/1928 | Kass | 30/162 |
| 2,741,025 | 4/1956 | Stewart | 30/368 X |
| 3,819,108 | 6/1974 | Jordan . | |
| 3,820,279 | 6/1974 | Seiper . | |
| 4,002,366 | 1/1977 | Hammes | 30/162 X |
| 4,158,197 | 6/1979 | Takagaki . | |
| 4,192,066 | 3/1980 | Tucker | 30/162 |
| 4,335,377 | 6/1982 | Bostic . | |
| 4,393,587 | 7/1983 | Kloosterman | 30/162 |
| 4,489,943 | 12/1984 | Werft | 30/368 |
| 4,565,372 | 1/1986 | Werft | 30/368 |
| 4,713,886 | 12/1987 | Ikeda | 30/366 |
| 4,837,559 | 6/1989 | Green, Sr. . | |
| 5,086,377 | 2/1992 | Roberts | 362/102 |
| 5,476,192 | 12/1995 | Julinot | 116/DIG. 44 X |
| 5,517,180 | 5/1996 | Masi et al. . | |
| 5,588,214 | 12/1996 | Nelson | 30/368 |
| 5,617,075 | 4/1997 | Worth et al. . | |
| 5,629,679 | 5/1997 | Cranford et al. . | |
| 5,635,908 | 6/1997 | Soper . | |
| 5,722,169 | 3/1998 | Ozden | 30/162 |

*Primary Examiner*—Kenneth E. Peterson
*Attorney, Agent, or Firm*—Sven W. Hanson

[57] ABSTRACT

The invention is a hand-held self defense weapon having a protected stabbing point. The stabbing point is covered by a retractable cover. The cover may be slidably retracted into a body cavity by the pressure of the contacting object on a cover thrusting surface. The stabbing point, which is rigid to a grippable handle, is exposed by the retracting cover. An alarm is switched internally by the motion of the cover, eliminating manually switching by the user during emergencies. After use, the stabbing point is retained in a point guide which also acts to retain body tissue captured from the body penetrated. The configuration and dimensions of the weapon are such as to be comfortably carried in a person's hand and naturally employed in natural self-defense actions.

19 Claims, 1 Drawing Sheet

HAND-HELD SELF DEFENSE WEAPON WITH PROTECTIVE COVER

RELATED APPLICATIONS

This application claims priority from the provisional application having Ser. No. 60/066,606, filed Nov. 26, 1997.

BACKGROUND OF THE INVENTION

The present invention relates to personal self-defense devices. In particular, the present invention is a hand-held self-defense device using a stabbing point to inflict injury to an attacker.

Present self-defense devices range from pistols to billy clubs. However, both pistols and billy clubs are not suitable for a great portion of the population. Many people do not wish to carry guns and do not have the physical capacity to use a club against an attacker. There are a number of devices that are designed for use by women. The objective of many of these is to provide a self-defense weapon that does not require strength or skill and is safe for the user. A pepper fog spray canister is such a device. These are hand held canisters of compressed pepper spray (typically a combination of ground cayenne pepper) which are directed into the face of an attacker temporarily blinding and incapacitating them. These devices suffer from lack of effectiveness in some situations—they are just not powerful enough of a deterrent. Other more powerful agents are similarly used in self-defense sprays. However, these also have greater risk to the user. Stabbing devices can be effectively used to fend off attackers and do not require great strength or skill. A significant problem with stabbing devices is the risk to the user both before and during use. Any device that maintains an uncovered stabbing point may potentially injure the user while being transported or carried. Carrying an uncovered stabbing point is impractical, for example in a woman's pocketbook, because self inflicted wounds are too likely. A solution to self-injury is, of course, to cover the point when not in use. This, though, renders such a device useless for the average person. During the confusion and stress of a personal attack, the necessity of physically uncovering or uncapping a stabbing point before use will too greatly hinder most users. A self-defense weapon must be continuously ready for reflexive use to be effective. If the user must remember to activate, or uncover, or perform any other physical action not instinctive or autonomous in a defensive mode, it is too likely that the device will not be used effectively. To ensure that the self-defense weapon is properly used, it should integrate into the natural reflexive actions of persons in a mode of self-defense.

What is needed is a self-defense weapon that provides a strong deterrent to attackers, is safe for the user, and is readily used in a natural reflexive self-defense mode.

SUMMARY OF THE INVENTION

It is an object of the invention to provide a personal self-defense device that will be naturally used in a reflexive self-defense mode.

It is a further object of the invention to provide a self-defense weapon having a stabbing point that is covered when not in use and is automatically exposed when thrust at an attacker.

It is a further object of the invention to provide a self-defense weapon having a warning alarm that is automatically initiated when a stabbing point is thrust at an attacker.

It is yet another object of the present invention to provide a self-defense weapon having a stabbing point that, after contact with an attacker, is retained such as to capture and retain any bodily tissues of the attacker for identification purposes.

The invention includes a rigid stabbing point that is protected by a retractable cover until the moment of use. The cover is automatically retracted to expose the point as it is thrust at an attacker. Retraction of the cover is induced by pressure on the cover from the body of the attacker. The cover retracts into or onto a handle that is shaped, sized and configured to be held and carried with ease and comfort in a natural manner. The device is configured such that striking or hitting an attacker in a natural defensive motion with the hand grasping the handle will effectively expose the point to penetrate the attacker. The cover is otherwise held in a position such that the point is not exposed accidentally. In a preferred design, the handle is a high impact polystyrene tubular member having a hollow core. A stabbing point is rigidly connected to the handle through a support integral with the handle. The point cover is preferably a hollow tube closed at one end except for a small hole through which the point may project. The cover slides over the point and into an opening in the handle. At the opposite end of the handle, an alarm is internally supported. A battery is also stored within the handle. A plunger extends from the end of the cover that is within the handle. Both the cover and plunger slide longitudinally with respect to the handle. An electrical contact is located on the plunger such that at one extreme of the plunger's motion, the contact meets a second contact or battery terminal such as to complete an electrical circuit providing power to the alarm. No external switch is required to activate the alarm. When the cover is pushed back within the handle as the device is thrust at an attacker, the plunger also is pushed back to complete the circuit and sound the alarm. The circuit is only broken when the cover is allowed to slide into a position covering the point. A button or raised knob on the cover exterior mates with stop holes in the handle to locate the cover with respect to the handle. Alternatively, the cover springs back when pressure is removed from its exterior end, while the alarm continues to sound. A spring biases the plunger against the cover end. At its greatest extent, the stabbing point projects a predetermined distance, preferably about 0.5 inches. This limited point is sufficient to inflict serious pain without causing permanent damage to an attacker. The cover includes a receptacle in which the point is retracted when cover. The receptacle provides for retention of any body tissues captured on the stabbing point. In this manner, the body tissues may be retained and used to help identify an attacker who escapes after an attack. A secondary external switch is also provided in some configurations for initiating the alarm without exposing the point. The device has an overall length of about five to eight inches, and preferably about six inches. This length satisfies the requirements of comfort and proper delivery of the stabbing point in natural self-defense actions.

The novel features of the present invention provide a self-defense weapon having elements of safety and effectiveness not provided or contemplated by prior self-defense devices. The design and novelty of the present invention provide a weapon that is easily and readily carried and naturally used thereby being greatly more effective than previous self-defense weapons.

DESCRIPTION OF THE PREFERRED EMBODIMENTS

A handle is provided which fits within a human hand and is easily carried when walking or running. Selection of size, shape, and materials must contemplate comfort and ease of use. The major functional elements other than the handle are a stabbing point, a retractable point cover, and an alarm. The alarm is configured to activate automatically upon the cover being pushed back as the point is thrust at an attacker. Alarm activation must be enabled without any manual switching by the user. Similarly, exposing or readying the stabbing point does not require any manipulations by the user. The cover encloses the stabbing point while being carried to protect the user from self-inflicted wounds during normal daily functions. The cover may be forced from its ready position by the pressure of thrusting the cover end of the device against an attacker's body. It is essential that the point be exposed as a result of the defensive motion of the user—thrusting at a resisting object.

Figure 1:
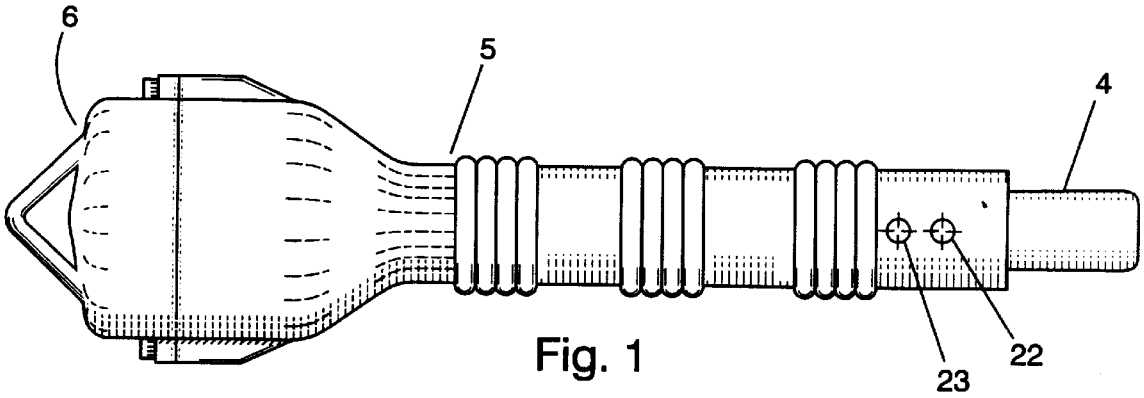
FIG. 1 is an external view of one embodiment of the invention.
Figure 2:
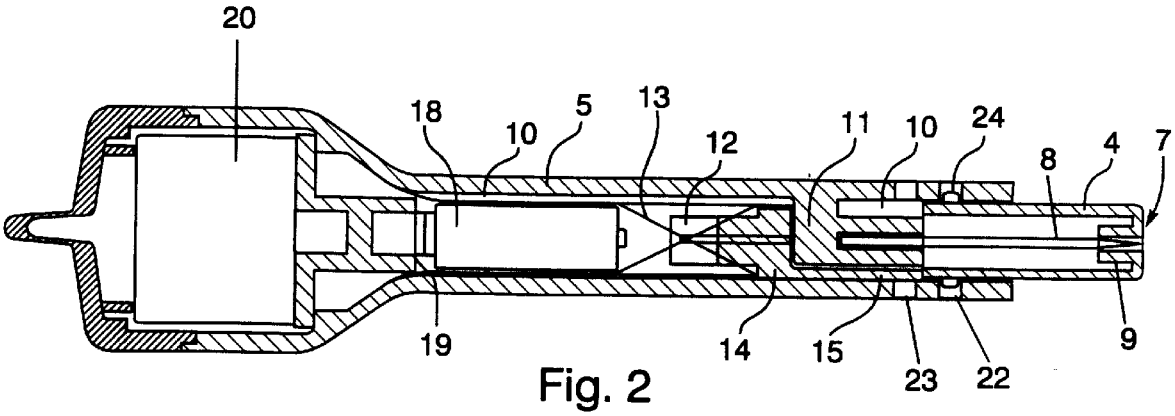
FIG. 2 is a section view of the embodiment of FIG. 1 in which a stabbing point is shown covered.
Figure 3:
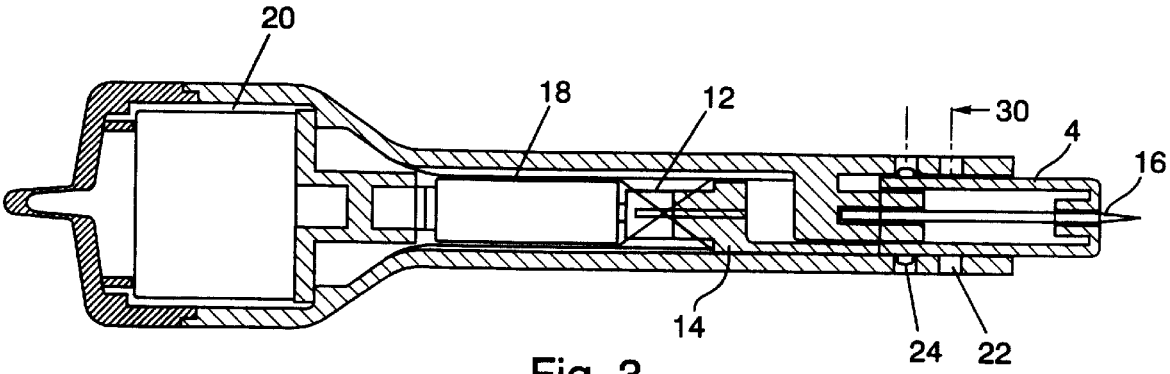
FIG. 3 is the same view as FIG. 2 but with the cover retracted to expose the stabbing point.

The elements of the present invention are best understood with respect to the examples detailed below and depicted in FIGS. 1 through 4. FIG. 1 is an external view of a preferred embodiment of the invention. A body 5 of the device is enlarged at one end to accommodate an internal alarm (shown in FIG. 2). The enlarged end is covered by a perforated cap 6. The opposite end of the device is terminated in a moveable spike cover 4. The body 5 here includes circumferential ridges to improve grip. The overall length, from the end of cap 6 to end of cover 4, should be such as to be easily carried when the user is walking or running. Preferably the overall length is about five to eight inches and most preferably about six inches. A length much greater than eight will not be comfortable for the average person engaged in daily activities. If the length is such as to be uncomfortable or unwieldy, it is too likely that the device will not be carried and used. It is essential to effective use that the device is carried at the ready. Additionally, the short length ensures that the stabbing spike 8 (FIG. 2) remains very close to the hand when the body 5 of the device is gripped. When the point of the stabbing spike is close to the hand it is naturally brought to bear on an attacker when the hand is thrust in a defensive gesture. A person who reflexively strikes with either an overhand or backhand motion will inevitably impact with the stabbing spike. It the length is such that the point of the stabbing spike is distant from the hand, the point may not be properly directed at the attacker, but must be more consciously aimed. As well, any length protruding from the hand of the user is more likely to be ensnared in an attacker's clothing or grabbed by the attacker. The outside diameter of the body 5 also must be comfortable to the user and of a size to be strongly grasped. For the average person, a body 5 diameter of 0.7 inches is preferred. A difficulty of the above requirements is in fitting all the necessary structures into the limited dimensions. FIG. 2 is a section view of the embodiment of FIG. 1. The cover 4 is shown to be retained within an open end of a body cavity 10. The cover is circular in cross section and its outside diameter is slightly less than the internal diameter of the cavity 10. The cover 4 is thereby longitudinally slidable with respect to the body 5. A stabbing spike 8 is rigidly connected to the body 5 through a spike support 11 and extends beyond the opening of the cavity 10. The spike 8 is preferably aligned with its longitudinal axis parallel to, and on, the longitudinal axis of the body 5. The cover 4 is normally retained in a position such that a thrusting surface 7 of the cover is positioned beyond the tapered spike point 16 such as to protect it. The spike point 16 is in this position protected from outside contact. The spike point 16 is captured in a sleeve 9 that extends inwardly from the thrusting surface 7 of the cover 4. The sleeve is hollow and terminates at an opening on the thrusting surface 7 through which the spike 8 passes when the cover is retracted. The thrusting surface 7 is preferably perpendicular to the longitudinal axis of the spike 8. The internal dimensions of the sleeve 9 form a space that will contain both the spike point 16 and any body tissues that may be retained on the point after use. On the outer surface of the cover 4 raised buttons 24 are positioned to align with stop holes 22 and 23 in the body. These buttons 24 act to moveably retain the cover in predetermined positions. Preferably, for balance, buttons are provided as matching pairs on diametrically opposite sides of the cover. In a first position, where the spike point 16 is covered as described above, the buttons 24 are retained in one set of stop holes 22. To slide the cover 4 within the body 5, the buttons 24 must be forced out of the stop holes 22 as the cover walls are compressed inwardly by the thickness of the buttons. As the cover 4 is slid into the body 5, a second position is reached in which the buttons 24 snap into a second set of stop holes 23. The interference of the buttons with the body internal dimension acts to control and locate the cover with respect to the body. This is only one method of accomplishing this function. The same function can be achieved by other structures. For example, in a distinct configuration, the outer travel limit of the cover is defined by an internal shoulder on the body 5 interfering with a ring extending outward from the cover. The cover inward travel can also be limited by bottoming on a stop positioned on the body internal walls. The effect of this structure is to hold the cover in a position covering the spike point but allowing the movement of the cover by overcoming a resisting force. The resisting force is overcome during use in the act of thrusting the device at an attacker. As the thrusting surface is stopped by contact with the attacker, the body 5 continues to advance with the thrust as the cover 4 is slid into the body cavity 10. The spike point 16 is trust forward along its longitudinal axis, out of the cover, entering the attacker until a second limit of the cover travel is reached with the buttons 24 in the second stop holes 23. In the figure, the travel of the cover with respect to the body, and therefore the travel of the spike point 16 outside the cover, is defined by the distance between the first stop holes 22 and the second stop holes 23. This dimension 30 is preferably 0.5 inches. By limiting the effective spike point length to this dimension 30, the potential damage to the attacker is also limited. What is needed is to produce intense pain without permanent damage. If a spike point dimension of much greater than 0.5 inches is used, the potential for permanent damage to the attacker (or accidentally to the user) is greatly increased. On the other hand, tests have shown that an exposed point length of 0.25 inches in many cases will not cause significant pain due to lack of penetration.

Figure 4:
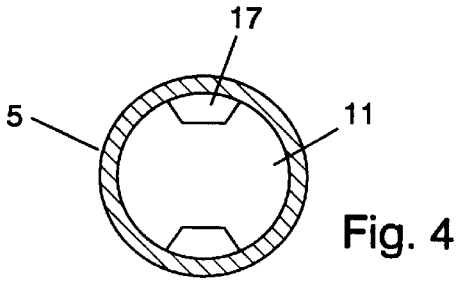
FIG. 4 is a section view from FIG. 2 showing internal detail.

Another significant feature of the invention, as a self-defense weapon, is an alarm sufficiently loud to both alert the local public and to produce in attackers a fear of discovery. The alarm 20 in the figures is mounted rigidly within the cavity 10 of the body 5. A battery 18 to power the alarm is also provided adjacent to the alarm 20. The alarm 20 is preferably a piezoelectric horn, many of which are available to manufacturers. An acceptable horn is the model PS-453 12 volt piezoelectric horn made by the HitPoint Company of Taiwan and currently distributed in the U.S. by the Mallory Company of Indiana. This is best powered by an Energizer A-23 12 volt battery. These products and equivalents are known and available. Preferably, no external alarm switch is required; rather the alarm is initiated by the act of trusting the weapon. To accomplish this, an electrical circuit providing power from the battery 18 to the alarm 20 is designed to be closed by the sliding movement of the cover 4. A battery access cover is preferably provided on the body 5. A plunger 14 is located between the cover 4 and battery 18 and slides longitudinally within the cavity 10. A plunger arm 15 extends to contact the lower edge of the cover 4. A spring 13 (shown schematically) is compressed between the plunger 14 and battery 18 to force the plunger arm 15 in continuous contact with the cover 4. FIG. 4 depicts a cross section of the spike support 11. The spike support 11 is formed integral to the inner walls of the body 5 and includes passages 17 in which the plunger arm 15 passes to reach the cover 4. An electrical contact 12 is located on the plunger 14 and aligned with a second contact, here the central battery terminal. In a ready position, the two contacts are separated. When the cover 4 is pushed into the body 5 in use, the plunger arm 15 drives the plunger 14 to force the contacts together. The electrical circuit is completed providing power to the alarm and creating the alarm sound. The contacts remain together while the cover is held in the second position with the buttons 24 captured in the second stop holes 23. In this manner, so long as the spike 8 is exposed, the alarm sounds. No external switching of the alarm by the user is necessary. Wires are attached to the alarm electrical contacts and threaded through the cavity 10 to the battery 18 and plunger contact 12. The wire to the plunger contact 12 passes from the alarm, adjacent the battery 18, and then along a groove in the plunger 14 and through a longitudinal hole in the plunger 14 to the contact 12. Alternatively, an external alarm shutoff switch may be provided, but this is not preferred. The cover 4 must be manually pulled from the body 5 to cover the spike 8 and open the alarm circuit. There are additional benefits which may be provided by a second external alarm switch. Such a switch, located on the external surface of the body 5 in a convenient position for thumb activation, may be used to initiate the alarm without exposing the point. This secondary switch would be independent of the above automatic switching which occurs upon movement of the cover 4. The secondary switch allows users to employ the alarm prior to actual defensive acts, such as to scare away threatening dogs and suspected attackers, or alert the public. To ensure that the automatic nature of the alarm feature is not weakened, this external switch should preferably not be capable of opening the automatic switching power circuit. There are many alternative methods of forming the circuits to provide power to the alarm as discussed above. These will be obvious to one skilled in the art.

In an alternative configuration, the cover 4 is allowed to slide freely between the two limits of motion described above. In this manner, as soon as the device is withdrawn from an attacker's body, the spike point 16 is covered by the cover 4 returning to its outward most position. The plunger 14, once driven by the cover 4 to place the contacts together, remains in that position when the cover slides outward to cover the point; the plunger arm 15 and cover 4 being now separated. In this manner, the alarm continues to sound and the spike point 16 is safely covered. A separate structure is then provided to push the plunger back into position, with the plunger arm in contact with the cover. This may be an additional spring functionally found between the body 5 and plunger 14 and an external mechanical switch or release. In yet another form, the body 5 resides within the cover 4, the cover sliding on the body external surface.

To produce a lightweight and comfortably carried self-defense weapon, the body 5 of the present invention is preferably molded of high impact polystyrene. Other plastics are potentially employed, but must be sufficiently rigid and strong to support the spike in the small dimensions of the device. Metals may also be used, but are generally heavier and not as comfortable to the human hand. Plastics also allow grip enhancements such as ridges to be easily incorporated into the body. The spike is formed of steel, preferable about 0.07 to 0.09 inches in diameter. The length of the spike is matched to the length of the cover and the maximum exposed point length needed. In alternative configurations, the spike includes structures to increase capture of tissue from the attacker's body. This may include barbs or holes in the spike that will carry away tissue or blood after penetration of the attacker's body by the spike. The cap 6 covering the alarm is perforated to limit sound reduction. The manner of forming a body 5 with a cavity 10 as shown and mounting the various components will be obvious to one skilled in the art after reading the above description. Alternative materials and methods are available and may be used to implement the novel features and characteristics of the claimed invention. The above description is only exemplary; the scope of the invention is defined by the below claims.

I claim:

1. A hand-held self-defense weapon which is easily and safely carried and is more naturally directed at an attacker through defensive motions of a person, the weapon comprising:

a. a body having a cavity;

b. an electric alarm, the alarm comprising:

a sounding device, an electrical power source, and an electrical circuit functionally connected to the power source and to the sounding device, the circuit being open in a first position and closed in a second position, and the alarm being disposed in the cavity;

c. a stabbing spike, the stabbing spike being rigidly fixed to the body;

d. a cover, the cover being moveably connected to the body and covering the stabbing spike in the first position, and exposing the stabbing spike in the second position;

whereby when the cover is moved from the first to the second position, the stabbing spike is exposed while the sounding device is automatically initiated.

2. The device of claim 1, wherein:

the stabbing spike has a predetermined exposed length in the second position.

3. The device of claim 2, further comprising:

a predetermined overall length, the overall length being such as to allow comfortable carrying of the stabbing spike by a person.

4. The device of claim 3, wherein:

the overall length is about 5 to 8 inches.

5. The device of claim 4, wherein:

the cover further comprises a thrusting surface, the thrusting surface having a spike hole;

the stabbing spike being aligned with the spike hole in the first position; and in the second position the stabbing spike extending through the spike hole the exposed length.

6. The device of claim 5, wherein:

the cover further comprises a hollow sleeve extending from the thrusting surface, the sleeve being aligned with the spike hole, and the stabbing spike further comprises a tapered point, the tapered point being retained in the sleeve in the first position.

7. The device of claim 6, further comprising:

a spring connected between the body and the cover such as to bias the cover into the first position.

8. The device of claim 7, further comprising:

retention means for retaining the cover alternatively in the first and second positions.

9. The device of claim 8, wherein:

the electrical circuit further comprises a pair of electrical contacts spaced apart in the first position and being forced together when the cover is placed in the second position.

10. The device of claim 9, further comprising:

a plunger, the plunger extending from the cover, and having attached one of the pair of contacts.

11. The device of claim 2, wherein:

the exposed length is about 0.5 inches.

12. A hand-held self-defense weapon comprising a. an elongated stabbing point having a predetermined length to be exposed as a weapon;

b. cover means for covering the stabbing point and preventing accidental contact by the user;

c. exposing means for exposing the predetermined length of stabbing point, the exposing means operating only when the stabbing point is thrust at a resisting object; and d. alarm means including automatic initiation means for automatically initiating the alarm means when the exposing means exposes the predetermined length of stabbing point.

13. The device of claim 12, further comprising:

a gripping means for allowing a user to grip and thrust the stabbing point in a natural and reflex action.

14. The device of claim 13, further comprising:

a predetermined overall length, the overall length being such as to allow comfortable carrying of the stabbing point by a person.

15. The device of claim 14, wherein:

the overall length is about 5 to 8 inches.

16. A hand-held self-defense weapon which is easily and safely carried and is more naturall directed at an attacker through defensive motions of a person, the weapon comprising:

an elongated stabbing spike, the spike having a point;

a point cover, the cover having a cavity, the cavity having an opening, the cover also having a thrusting surface;

the point being moveably disposed in the cavity and adjacent the thrusting surface such that a force exerted on the thrusting surface will cause the cover to move and the point thereby to extend through the opening;

an electric alarm attached to said spike;

the alarm comprising a sounding device, a power source and a connecting electric circuit, the circuit comprising a pair of contacts separated in an initial condition, one of the contacts being relatively fixed to the spike and the other being relatively fixed to the cover, the pair of contacts being aligned to be thrust together when the cover moves, thereby causing the alarm to sound.

17. The device of claim 16, further comprising:

a spring connected between the spike and cover such as to bias the cover into a position covering the point.

18. The device of claim 17, further comprising:

a stop relatively rigidly connected to the spike and aligned to stop the movement of the cover so as to limit the extension of the point through the opening to a predetermined length.

19. The device of claim 18, wherein:

the predetermined length is about 0.5 inches.

* * * * *